US010221831B2

(12) United States Patent
Masson et al.

(10) Patent No.: US 10,221,831 B2
(45) Date of Patent: Mar. 5, 2019

(54) RADIAL PISTON MACHINE HAVING BRAKING MEANS SECURED AGAINST TWISTING

(71) Applicant: Robert Bosch GmbH, Stuttgart (DE)

(72) Inventors: Laurent Masson, Kirkcaldy (GB); Johannes Offenburger, Glenrothes (GB); Sven Hirschberg, Aspach (DE); Peer Fischer, Kirkcaldy (GB)

(73) Assignee: Robert Bosch GmbH, Stuttgart (DE)

( * ) Notice: Subject to any disclaimer, the term of this patent is extended or adjusted under 35 U.S.C. 154(b) by 144 days.

(21) Appl. No.: 15/349,450

(22) Filed: Nov. 11, 2016

(65) Prior Publication Data

US 2017/0138334 A1 May 18, 2017

(30) Foreign Application Priority Data

Nov. 12, 2015 (DE) ..... 10 2015 222 291

(51) Int. Cl.

| | |
|---|---|
| ***F04B 1/04*** | (2006.01) |
| ***F03C 1/04*** | (2006.01) |
| ***F03C 1/40*** | (2006.01) |
| ***F03C 1/047*** | (2006.01) |
| ***F04B 1/047*** | (2006.01) |

(Continued)

(52) U.S. Cl.

CPC ..... *F03C 1/0403* (2013.01); *F03C 1/047* (2013.01); *F03C 1/0412* (2013.01); *F03C 1/0447* (2013.01); *F03C 1/0472* (2013.01); *F04B 1/0404* (2013.01); *F04B 1/047* (2013.01); *F04B 1/0472* (2013.01); *F04B 49/02* (2013.01)

(58) Field of Classification Search

CPC ..... F03C 1/0403; F03C 1/045; F03C 1/0454; F03C 1/2407

See application file for complete search history.

(56) References Cited

U.S. PATENT DOCUMENTS

| | | | |
|---|---|---|---|
| 3,690,097 | A | 9/1972 | Widmaier |
| 5,115,890 | A | 5/1992 | Noel |
| 5,209,064 | A | 5/1993 | Noel et al. |

(Continued)

FOREIGN PATENT DOCUMENTS

| | | |
|---|---|---|
| DE | 198 14 273 A1 | 10/1999 |
| DE | 10 2011 119 294 A1 | 5/2013 |

(Continued)

*Primary Examiner* — Thomas E Lazo

(74) *Attorney, Agent, or Firm* — Maginot, Moore & Beck LLP

(57) ABSTRACT

A radial piston machine includes a housing, rotor, first braking member, and brake ring with a second braking member. The rotor is mounted in the housing to be rotatable relative to an axis of rotation, and has an end face facing in a direction of the axis of rotation. The first braking member is positioned on the end face. The housing has a body defining a ring-shaped extension relative to the axis of rotation. The brake ring is positioned to surround the extension and is configured to be movable in the direction of the axis of rotation so as to bring the second braking member into braking engagement with the first braking member. The brake ring is further configured to positively engage with an inner radial side of the extension to limit a twisting between the housing and brake ring.

14 Claims, 8 Drawing Sheets

(51) Int. Cl.
*F04B 49/02* (2006.01)
*F03C 1/30* (2006.01)

(56) References Cited

U.S. PATENT DOCUMENTS 9,518,466 B2 * 12/2016 Vidal ..... B60K 17/105
9,777,573 B2 * 10/2017 Just ..... F01B 13/061
9,982,782 B2 * 5/2018 Vidal ..... F16J 15/004

FOREIGN PATENT DOCUMENTS

DE 103 92 363 B4 1/2015
GB 2403513 A * 1/2005 ..... F03C 1/045

* cited by examiner

RADIAL PISTON MACHINE HAVING BRAKING MEANS SECURED AGAINST TWISTING

This application claims priority under 35 U.S.C. § 119 to patent application no. DE 10 2015 222 291.8, filed on Nov. 12, 2015 in Germany, the disclosure of which is incorporated herein by reference in its entirety.

The disclosure relates to a radial piston machine.

BACKGROUND

U.S. Pat. No. 5,115,890 discloses a radial piston machine having braking means which are in the form of a multi-disk brake. Some of the brake disks are secured against twisting on the housing.

U.S. Pat. No. 5,209,064 discloses a radial piston machine having braking means in which a first rotary bearing rests directly on an end face of the rotor. The braking means are arranged away from this end face.

U.S. Pat. No. 3,690,097 discloses a radial piston machine in which two rotors are coupled to one another selectively by means of a dog clutch.

SUMMARY

One advantage of the present disclosure is that the anti-twist safeguard required for the braking means can be provided by unmachined cast surfaces. Nevertheless, there is no risk of jamming or tilting of the braking means during operation. Moreover, the radial piston machine is of particularly compact design. The abovementioned selectable dog clutch can be used without reservations as a braking means, the said clutch forming a holding brake which is preferably engaged or disengaged when shut down.

According to this disclosure, the housing has an extension, which is ring-like in relation to the axis of rotation and which is surrounded by a separate brake ring, wherein the brake ring is movable in the direction of the axis of rotation, wherein it has second braking means, which can be brought into braking engagement with the first braking means by a movement of the brake ring in the direction of the axis of rotation, wherein the brake ring engages positively on the radially inner side thereof in the ring-like extension in such a way that twisting between the housing and the brake ring is at least limited. The positive engagement between the brake ring and the ring-like extension can thus be arranged in immediate spatial proximity to the engagement between the first and the second braking means. Thus, tilting of the brake ring is excluded, even when the positive engagement bears on only one location of the circumference of the ring-like extension. Consequently, the corresponding positive engagement contours can be produced with large dimensional tolerances of the kind that are typical for the casting process.

The housing preferably has a first and a second fluid connection, wherein a fluid distributing device is arranged in the housing, the said device being designed in such a way that each first fluid chamber can be fluidically connected selectively to the first or the second fluid connection by turning the rotor. The control surface preferably has a cross-sectional profile which is designed so as to be constant along the axis of rotation. The radial piston machine is intended for use with a pressurized fluid, which is preferably a liquid and most preferably hydraulic oil. The ring-like extension preferably surrounds the rotor, in particular the drive shaft thereof. The radial piston machine is preferably a radial piston motor, although it can also be a radial piston pump.

Advantageous developments and improvements of the disclosure are given in the claims, description, and drawings.

Provision can be made for a first rotary bearing, in which the rotor is mounted so as to be rotatable relative to the axis of rotation, to be accommodated on the radially inner side of the ring-like extension. The corresponding radial piston machine is of particularly compact design. Moreover, the first rotary bearing is in immediate spatial proximity to the engagement between the first and the second braking means and to the positive engagement between the ring-like extension and the brake ring.

Elastic deformations of the radial piston machine caused by the forces which arise during braking are thereby minimized. As a result, the risk that the brake ring will tilt is low. In addition to the first rotary bearing, further rotary bearings can be arranged between the housing and the rotor. The first rotary bearing is preferably mounted on the drive shaft of the rotor.

Provision can be made for the first rotary bearing to be supported in the direction of the axis of rotation on the end face of the rotor. This makes it possible to arrange the first rotary bearing particularly close to the engagement between the first and the second braking means, thus minimizing the abovementioned deformations even further.

Provision can be made for the end face of the rotor, with the exception of the first braking means, to be of flat design, wherein it is aligned perpendicularly to the axis of rotation. Thus, the end face can be used directly as a contact surface for the first rotary bearing. Moreover, it can be produced easily and at low cost. The end face can be interrupted by slots, channels or the like in order to divert leaks past the first rotary bearing.

At least one spring can be provided, which is installed under a preload between the brake ring and the housing in such a way that the brake ring is pushed towards the end face of the rotor in the direction of the axis of rotation. Thus, the first and the second braking means are in engagement as long as the brake ring is not moved counter to the force of the at least one spring. Particularly in the case of a malfunction, this ensures that the radial piston machine cannot move. The at least one spring is preferably accommodated in each case in an associated first recess in the housing. The at least one spring is preferably designed as a helical spring, the central axis of which is aligned parallel to the axis of rotation. The at least one spring can also be designed as a wave spring or as a diaphragm spring. The first recess is preferably of circular-cylindrical design, wherein it is arranged parallel to the axis of rotation. The at least one spring is preferably arranged adjacent to the brake ring on the side remote from the rotor in the direction of the axis of rotation.

Provision can be made for a second fluid chamber to be provided, which is arranged in a ring-like manner around the brake ring and which is partially delimited by the housing, wherein the brake ring can be moved in the direction of the axis of rotation by pressurizing the second fluid chamber. Thus, the brake ring can be moved hydraulically counter to the force of the at least one spring. The corresponding pressure force acts in a uniformly distributed manner over the circumference of the brake ring, thus avoiding tilting of the brake ring. The direction of movement of the brake ring when the second fluid chamber is pressurized is preferably away from the end face of the rotor.

Provision can be made for the second fluid chamber to be partially delimited by a separate closure ring, which is arranged in a ring-like manner around the brake ring, wherein the closure ring rests fluidtightly against the housing on its radially outer side. Thus, the brake ring can be installed before the closure ring is inserted, wherein the installation of both components mentioned can take place from the inside of the housing. Any leaks which occur there flow into the interior of the housing and do not get into the environment of the radial piston machine.

Provision can be made for the housing to have a separate cam ring, on which the control surface is arranged, wherein the closure ring is supported on the cam ring in the direction of the axis of rotation. Thus, the position of the closure ring is defined by positive engagement, while, at the same time, the installation of the closure ring and of the cam ring is possible without problems. Because of the wave-like design of its control surface, the cam ring has end face components which project into the interior of the housing and can serve as a contact surface for the closure ring.

Provision can be made for the second fluid chamber to be partially delimited by the brake ring. In this embodiment, the closure ring rests by means of its radially inner side against the brake ring, preferably fluidtightly. When viewed in cross section, the brake ring is preferably of L-shaped design. It preferably rests fluidtightly by means of its radially outer side and in a manner which allows sliding movement against the housing. Particularly at this contact location, tilting is avoided by the present disclosure.

A separate annular piston can be provided, which is held on the brake ring so as to be rotatable relative to the axis of rotation, wherein it is supported on the brake ring in the direction of the axis of rotation, wherein the annular piston partially delimits the second fluid chamber. In this embodiment, the closure ring rests on its radially inner side against the annular piston, preferably fluidtightly. When viewed in cross section, the annular piston is preferably of L-shaped design. The annular piston and the closure ring are preferably arranged on opposite sides of the second fluid chamber. The annular piston preferably rests by means of its radially outer side fluidtightly and in a manner which allows sliding movement against the housing. Particularly at this contact location, tilting is avoided by the present disclosure.

Provision can be made for the housing to have a sealing surface which is circular-cylindrical in relation to the axis of rotation, wherein a section of the sealing surface delimits the second fluid chamber. The closure ring preferably rests on its radially outer side in a sealing manner against the sealing surface. The brake ring or the annular piston preferably rests fluidtightly against the sealing surface.

Provision can be made for the first braking means to be formed by a multiplicity of first extensions, which face the brake ring in the direction of the axis of rotation, wherein they are arranged in a uniformly distributed manner around the axis of rotation at a pitch, wherein the second braking means are formed by a multiplicity of second extensions, which face the first extensions in the direction of the axis of rotation, wherein they are arranged in a uniformly distributed manner around the axis of rotation at the said pitch. The first and the second braking means are thus designed in the manner of a dog clutch. The pitch is preferably made small to ensure that the first and the second braking means can engage in one another in as many different rotational positions as possible. The pitch is preferably between 4° and 15°, being 9°, for example. It is also conceivable for the first and the second braking means to be designed as friction linings. The side faces of the first and of the second extensions can be of sloping and/or rounded design to ensure that the dog clutch opens from a predetermined torque.

Provision can be made for the brake ring to have, on its radially inner side, at least two third extensions, which are arranged in a manner distributed around the axis of rotation, wherein they engage in respective matching second recesses on the ring-like extension. Twisting of the brake ring relative to the housing is thereby limited by positive engagement. The third extensions preferably engage with play in the respectively associated second recess. The third extensions and the second recesses preferably have an unmachined cast surface. The said clearance is preferably made such that it is present irrespective of the dimensional tolerances which arise during casting. The second recesses are preferably designed to be open radially outwards and axially towards the rotor in order to simplify mounting of the brake ring on the housing. The third extensions preferably face radially inwards.

Provision can be made for the at least one spring to be in each case arranged in the region of a second recess. Thus, the spring can in each case be supported on a third extension of the brake ring. The brake ring can thus be made thin and consequently in a manner which saves materials away from the third extensions.

It is self-evident that the features mentioned above and those which remain to be explained below can be used not only in the respectively indicated combination but also in other combinations or in isolation without exceeding the scope of the present disclosure.

BRIEF DESCRIPTION OF THE DRAWINGS

The disclosure is explained in greater detail below with reference to the attached drawings, in which.

DETAILED DESCRIPTION

Figure 1:
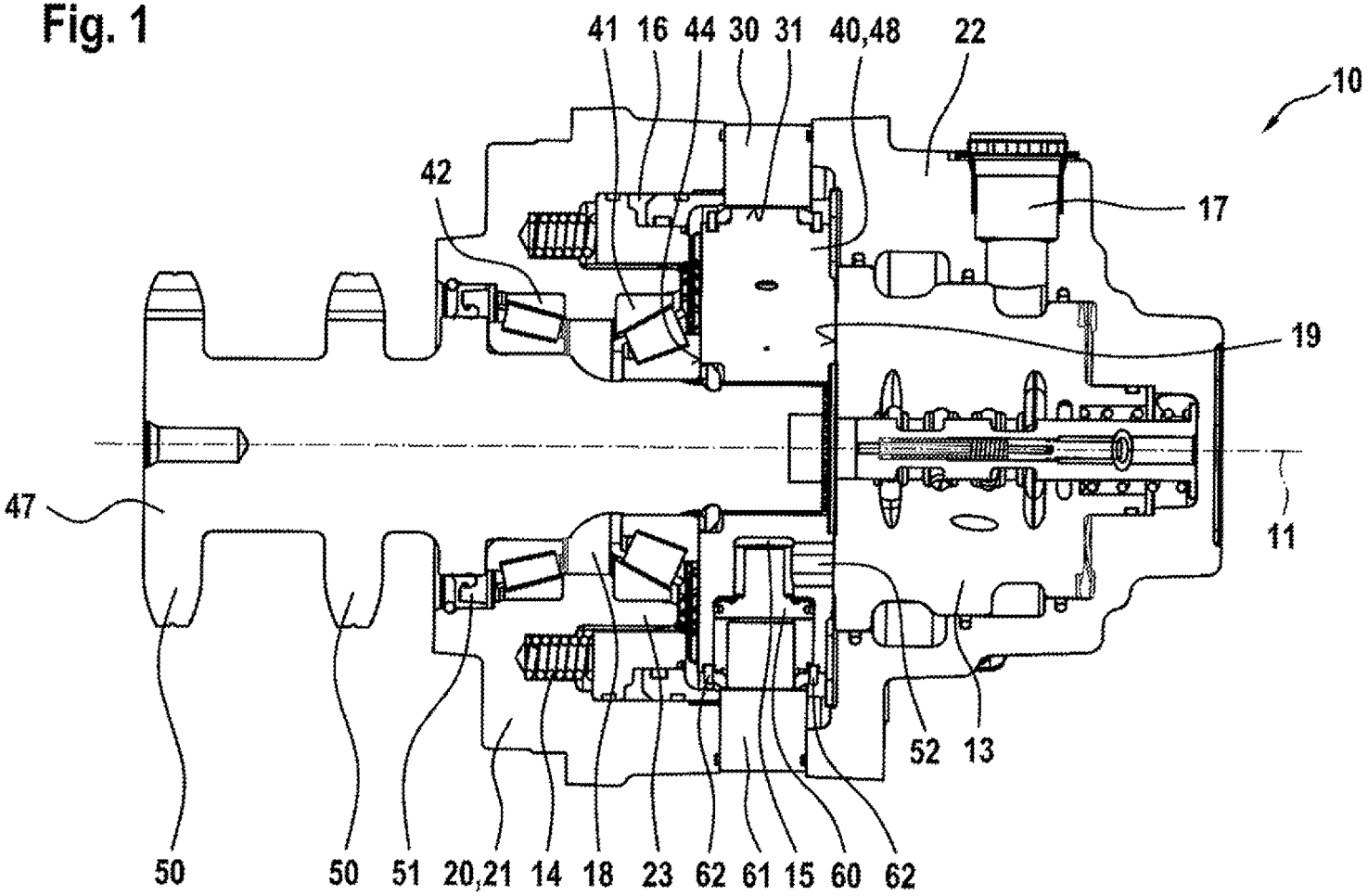
FIG. 1 shows a longitudinal section through a radial piston machine according to a first embodiment of the disclosure.

FIG. 1 shows a longitudinal section through a radial piston machine 10 in accordance with a first embodiment of the disclosure. The radial piston machine 10 has a housing 20, which is made up of a first housing part 21, a second housing part 22 and a cam ring 30, wherein the cam ring 30 is installed in a fixed manner between the first and the second housing part 21, 22. Accommodated in the first housing part 21 are a first and a second rotary bearing 41; 42, which are preferably designed as radial rolling bearings and, for example, as taper roller bearings. A drive shaft 47 is supported so as to be rotatable relative to an axis 11 of rotation in the first and the second rotary bearing 41; 42. The drive shaft 47 projects with a drive means 50 from the housing 20. The drive means 50 can be one or more gearwheels, for example. Arranged between the drive shaft 47 and the first housing part 21 is a seal 51, which is designed as a radial shaft sealing ring, for example. It should be noted here that the housing 20 surrounds an interior 18 which is closed off in a substantially fluidtight manner.

The drive shaft 47 is part of a rotor 40, which furthermore comprises a cylinder drum 48. In the present case, the drive shaft 47 and the cylinder drum 48 are designed as separate components, which are connected to one another for conjoint rotation with respect to the axis 11 of rotation by means of a splined profile (No. 49 in FIG. 3). The drive shaft 47 and the cylinder drum 48 have minimal capacity for movement relative to one another in the direction of the axis 11 of rotation, thus avoiding stress in the first and the second rotary bearing 41; 42. However, it is likewise conceivable for the drive shaft 47 and the cylinder drum 48 to be of integral design.

A plurality of pistons 60 is accommodated in the rotor 40 so as to be movable radially with respect to the axis 11 of rotation. The cam ring 30 surrounds the cylinder drum 48, wherein it has a control surface 31 which faces the cylinder drum 48. The control surface 31 delimits the radially outward path of movement of the pistons 60. Moreover, a first fluid chamber 15 is associated with each piston 60 on the radially inner side thereof. By pressurizing the first fluid chamber 15, the respective piston 60 can be pressed against the control surface 31, as a result of which rotary motion relative to the axis 11 of rotation is imparted to the rotor 40. During this process, some of the pistons 60 are pushed radially inwards by the control surface 31, thus reducing the volume of the corresponding first fluid chambers 15.

A first and a second fluid connection are provided on the second housing part 22, although only the first fluid connection 17 is visible in FIG. 1. Also accommodated in the second housing part 22 is a fluid distribution device 13, which is provided with a flat distribution surface 19 aligned perpendicularly to the axis 11 of rotation. Twelve outlet openings, for example, are arranged in the distribution surface 19 in a manner distributed around the axis 11 of rotation, wherein they are connected fluidically either to the first 17 or the second fluid connection. One fluid passage 52 for each first fluid chamber 15 is arranged in the cylinder drum 48, the said passage extending substantially parallel to the axis 11 of rotation. Depending on the rotational position of the rotor 40, this passage opens into one of the outlet openings mentioned, but it can also be blocked by the distribution surface 19. Thus, each first fluid chamber 15 can be fluidically connected selectively to the first 17 or to the second fluid connection by rotating the rotor 40.

Figure 2:
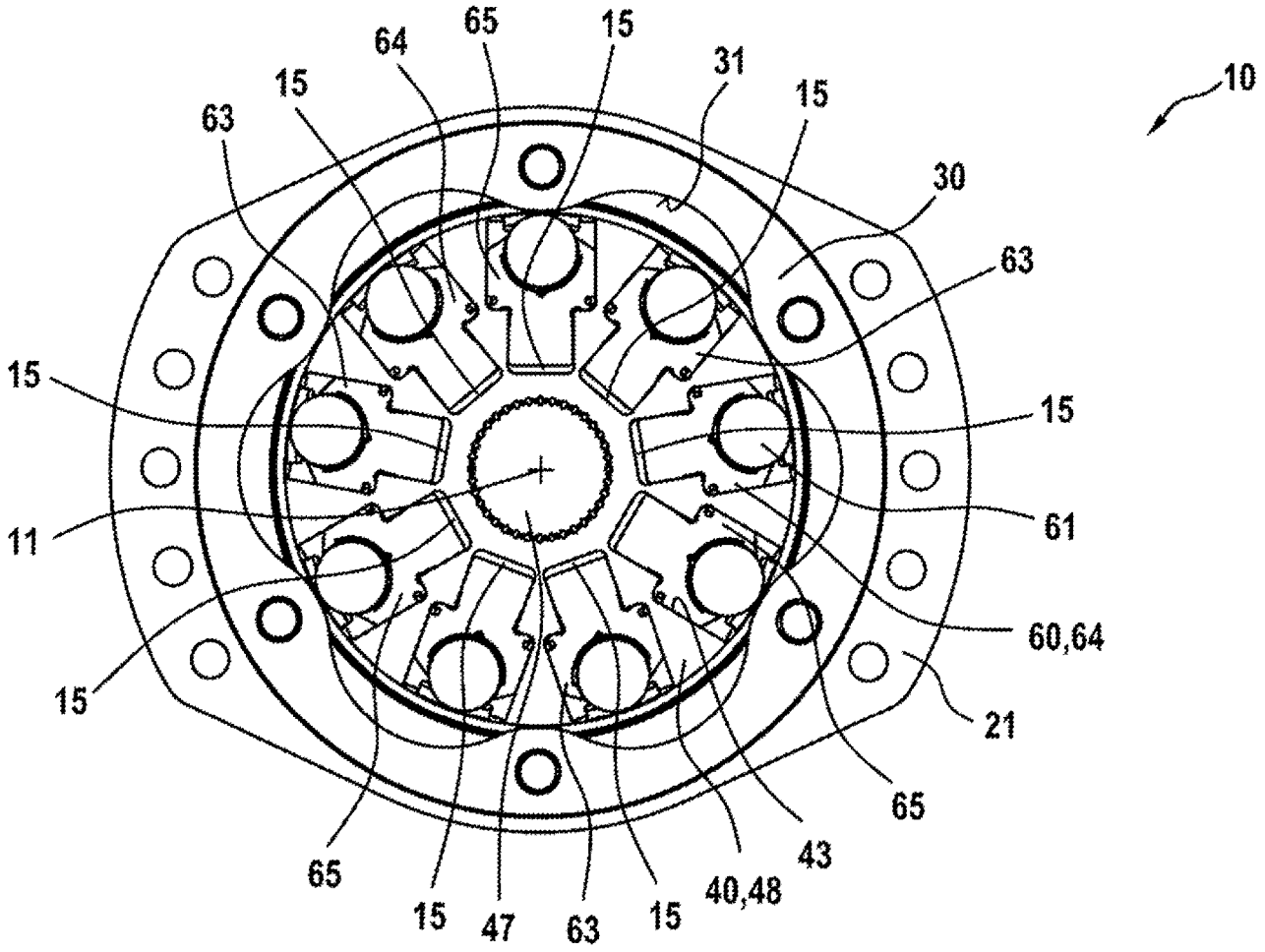
FIG. 2 shows a cross section through the radial piston machine shown in FIG. 1, wherein the section plane passes through the center of the pistons.

FIG. 2 shows a cross section through the radial piston machine 10 shown in FIG. 1, wherein the section plane passes through the center of the pistons 60. The control surface 31 runs continuously and without interruption around the axis 11 of rotation. The cross-sectional profile, shown in FIG. 2, of the control surface 31 is of constant design in the direction of the axis 11 of rotation over the entire width of the cam ring 60. The spacing between the control surface 31 and the axis 11 of rotation varies periodically along the circumference. In this case, six locations with a minimum and a maximum spacing, respectively, are provided, for example, with the result that a piston 60 performs six strokes for one revolution of the rotor 40.

The pistons 60 are of identical design to one another, wherein they are embodied as stepped pistons. They are each accommodated in a matching cylinder bore 43 in the cylinder drum 48, the said bore being designed as a stepped bore. Accommodated in each piston 60 is a circular-cylindrical roller 61, which rolls on the control surface 31. It should be noted here that all the pistons are shown in the same radial position in FIG. 2, although they are pressed against the control surface 31 by the pressure in the first fluid chamber 15 during operation, and therefore the pistons occupy different radial positions. When the corresponding first fluid chamber 15 is pressurized, the pistons 60 denoted by reference numeral 63 bring about an anticlockwise rotation of the rotor 40. The first fluid chambers 15, which are associated with the pistons 60 denoted by the reference numeral 64, decrease in size during this rotary motion. In the rotational position, shown in FIG. 2, of the rotor 40, the pistons 65 are in an extreme position.

The axes of rotation of the rollers 61 are aligned parallel to the axis 11 of rotation. The rollers 61 can be supported on the respectively associated piston 60 via a hydrostatic pressure field.

Figure 3:
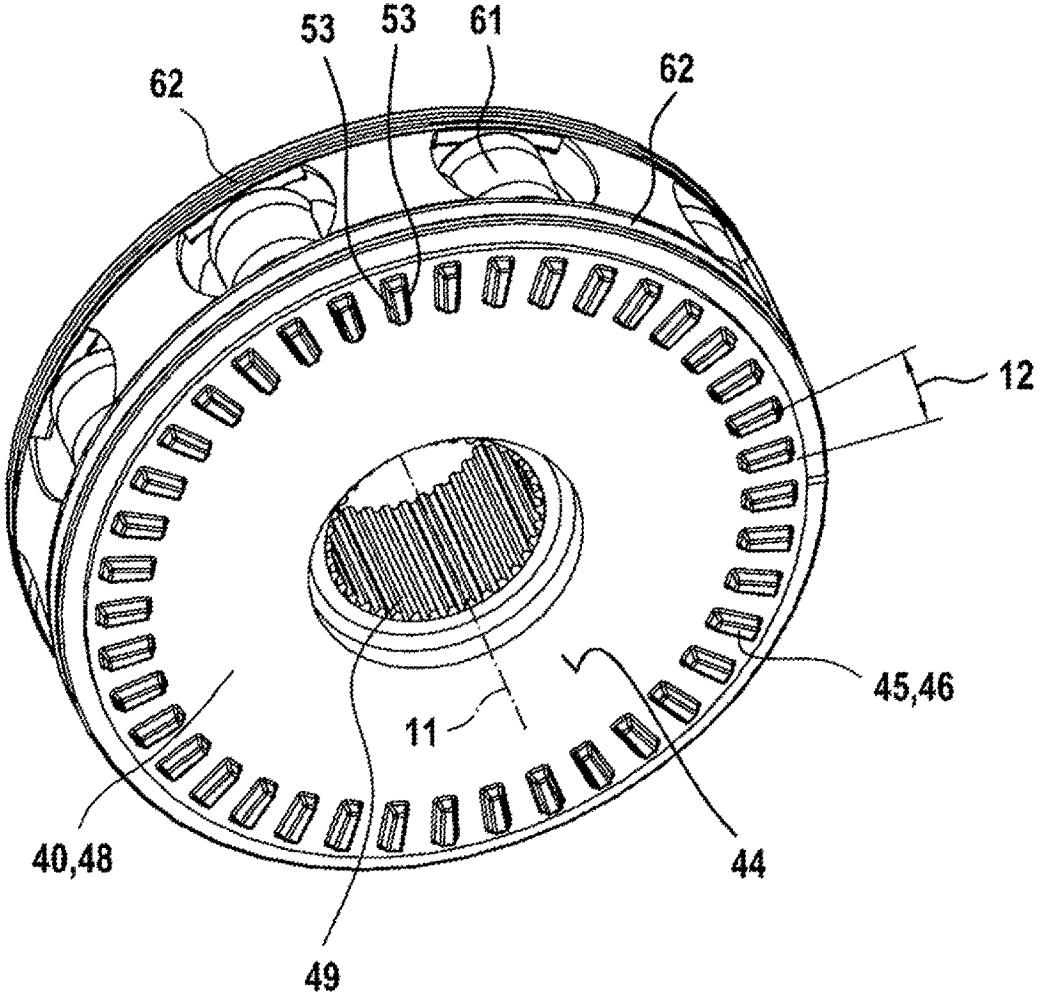
FIG. 3 shows a perspective view of the cylinder drum of the radial piston machine shown in FIG. 1.

FIG. 3 shows a perspective view of the cylinder drum 48 of the radial piston machine shown in FIG. 1. The cylinder drum 48 has a flat end face 44, which is aligned perpendicularly to the axis 11 of rotation, wherein it faces the first rotary bearing (No. 41 in FIG. 1). First braking means 45 are provided on the end face 44. The first braking means 45 comprise a multiplicity of first extensions 46, which are arranged in a uniformly distributed manner at a constant pitch 12 around the axis 11 of rotation. The first extensions 46 are of identical design to one another, wherein the spacing thereof with respect to the axis 11 of rotation is likewise identical. The side faces 53 thereof engage positively between the second extensions (No. 72 in FIG. 6), which form the second braking means. The said side faces 53 can be of flat and sloping design, with the result that the said positive engagement is canceled when a predetermined torque is exceeded. For this purpose, the side faces 53 can also be of rounded design.

Grooves or channels (not shown), by means of which fluid leaks can be guided past the first rotary bearing, can be provided in the end face 44.

Two retention rings 62 are arranged on the outer circumferential surface of the cylinder drum 48, the positive engagement of the said rings preventing the pistons (No. 60 in FIG. 2) from falling out of the respectively associated cylinder bore (No. 43 in FIG. 2) while the cylinder drum 48 is not mounted on the remainder of the radial piston machine. The retention rings 62 are arranged on opposite lateral rims of the cylinder drum 48 in the direction of the axis 11 of rotation.

As already explained, the cylinder drum 48 is provided with a splined profile 49, which engages positively in the drive shaft (No. 47 in FIG. 1).

Figure 4:
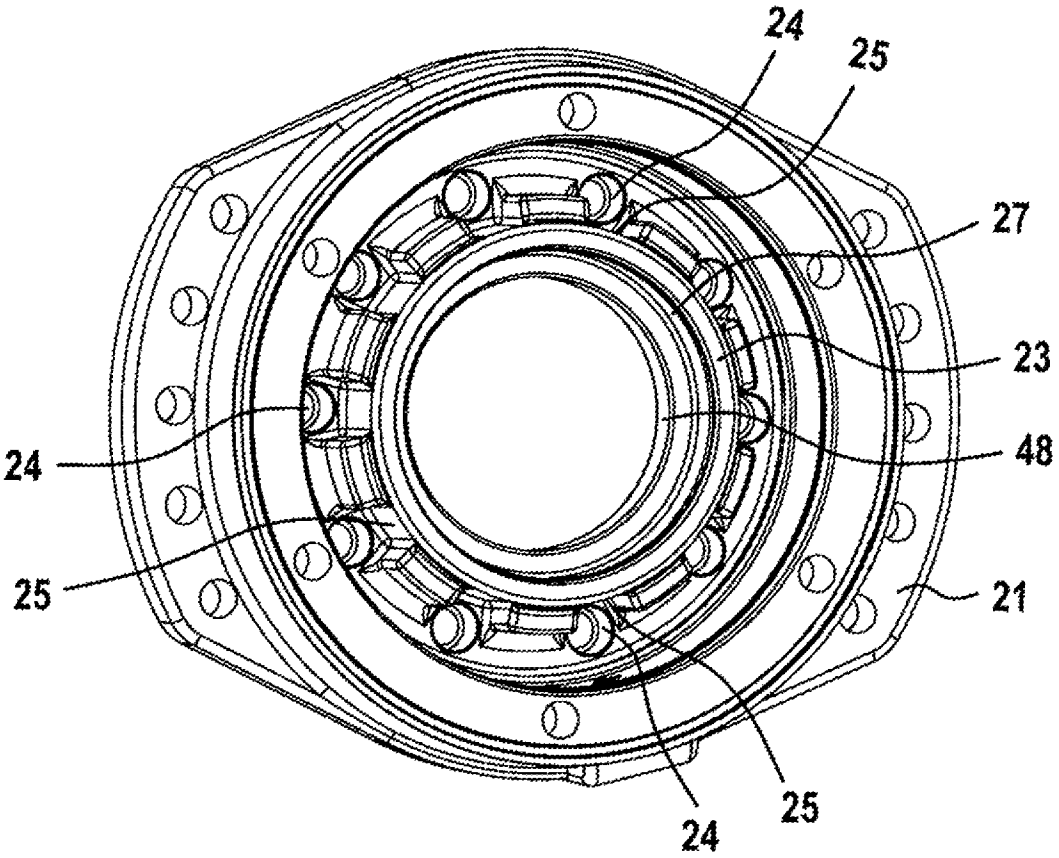
FIG. 4 shows a perspective view of the first housing part of the radial piston machine shown in FIG. 1.

FIG. 4 shows a perspective view of the first housing part 21 of the radial piston machine shown in FIG. 1. The first housing part 21 is of substantially pot-type design. FIG. 4 shows the side of the first housing part 21 which faces the cam ring (No. 30 in FIG. 1). On the one hand, it is possible to see the circular bore 28 in the bottom surface of the first housing part 21, through which the drive shaft (No. 47 in FIG. 1) passes. Arranged around the bore 28 is an extension 23, which is ring-like in relation to the axis of rotation (No 11 in FIG. 1) and projects into the interior (No. 18 in FIG. 1) of the housing. The first rotary bearing (No. 41 in FIG. 1), in particular the corresponding outer ring, is mounted on the radially inner side of the ring-like extension 23. The bearing seat 27 at that location is of circular-cylindrical design in relation to the axis of rotation (No. 11 in FIG. 1).

In the present case, a total of ten second recesses 25 is provided on the radially outer side of the ring-like extension 23, wherein the number mentioned is largely a matter of free choice. The recesses 25 are designed to be open toward the cylinder drum (No. 48 in FIG. 1) in the direction of the axis of rotation. Moreover, they are designed to be open radially outwards. When viewed in the direction of the axis of rotation, they have a rectangular or slightly trapezoidal cross-sectional profile. Third extensions (No. 73 in FIG. 6) on the brake ring engage in the second recesses 25, and therefore twisting of the brake ring relative to the housing is at least limited. One advantage of the present disclosure is that the second recesses 25 and the third extensions can have cast surfaces, which do not have to be finish-machined. They can therefore be embodied in a relatively imprecise and therefore low-cost way. Nevertheless, there is no risk that the brake ring will tilt.

Each second recess 25 is associated with a first recess 24, which is of circular-cylindrical design, wherein it is arranged in alignment with the relevant second recess 25 in the direction of the axis of rotation. The first recesses 24 extend parallel to the axis of rotation, wherein they have a constant depth. A spring (No. 14 in FIG. 5) is accommodated in each of the first recesses 24.

Figure 5:
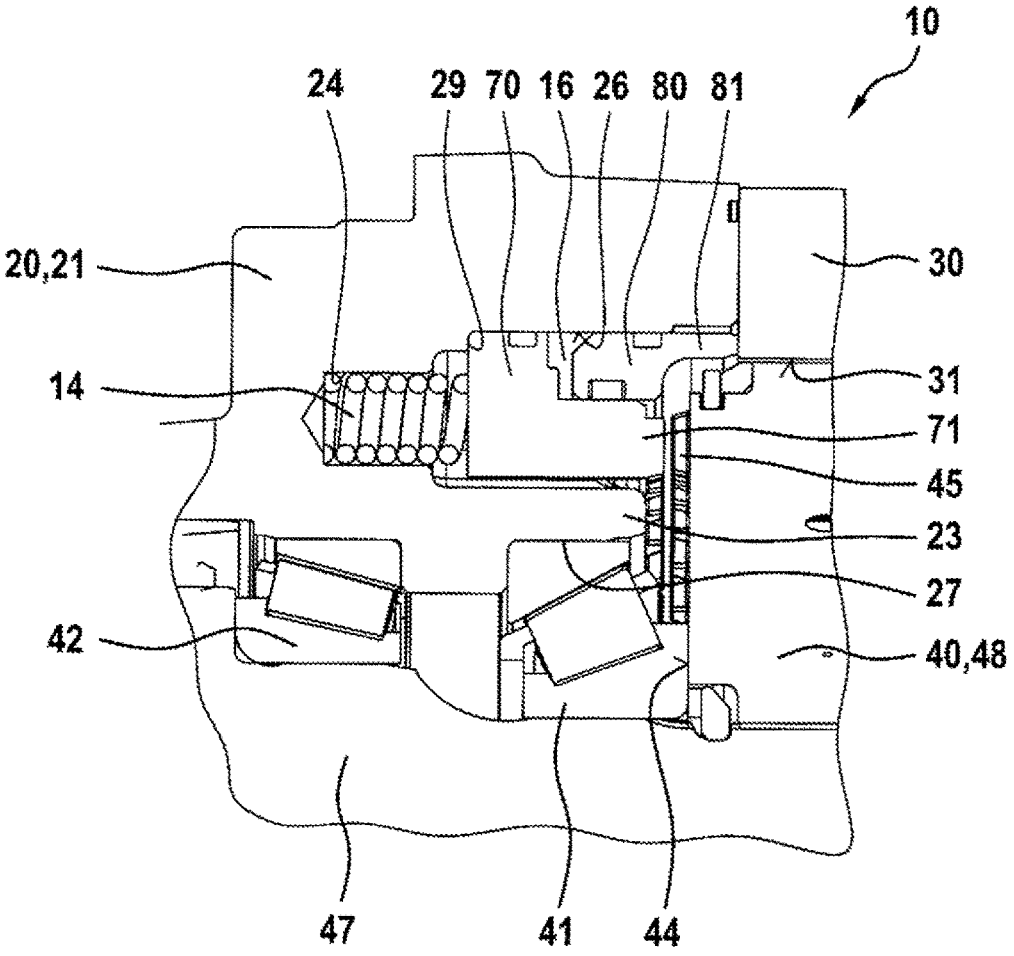
FIG. 5 shows an enlarged partial view of FIG. 1 in the region of the brake ring.

FIG. 5 shows an enlarged partial view of FIG. 1 in the region of the brake ring 70. The outer ring of the first rotary bearing 41 is mounted on the inside on the already discussed bearing seat 27 of the ring-like extension 23. The corresponding inner ring is mounted on the drive shaft 47, wherein it is supported on the end face 44 of the cylinder drum 48 in the direction of the axis of rotation.

Figure 6:
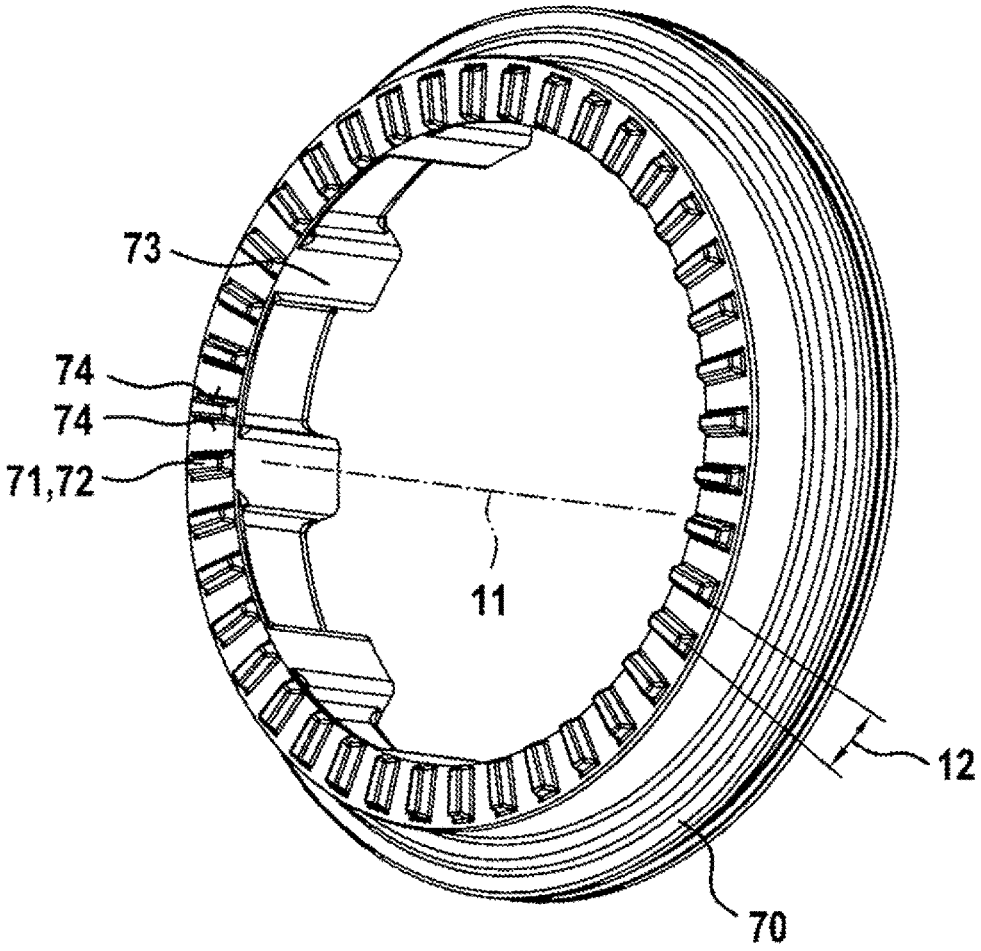
FIG. 6 shows a perspective view of the brake ring of the radial piston machine shown in FIG. 1.

Arranged around the ring-like extension 23 and hence around the first rotary bearing 41 is the brake ring 70, which is shown in greater detail in FIG. 6. On its right-hand side in FIG. 5, the brake ring 70 has second braking means 71, which are arranged exactly opposite the first braking means 45 on the cylinder drum 48 in the direction of the axis of rotation. The springs 14 rest against the left-hand side of the brake ring 70 in FIG. 5. In the present case, these springs are each designed as helical springs, although it is likewise conceivable to use diaphragm springs or wave springs. The springs 14 are very largely accommodated in a respectively associated first recess 24 in the first housing part 21, with the result that their position is fixed. The springs 14 are installed under a preload between the housing 20 and the brake ring 70, with the result that the brake ring 70 is pressed onto the cylinder drum 48. The corresponding path of movement is limited by the closure ring 80, which is supported on the cam ring 30 in the direction of the axis of rotation. In this case, the closure ring 80 is preferably designed in such a way that the tips of the second braking means 71 cannot come into contact with the end face 44.

It should be noted that FIG. 5 shows a position of the brake ring 70 in which the second fluid chamber 16 is supplied with fluid pressure, with the result that the brake ring 70 is in an end position in which the second braking means 71 do not engage in the first braking means 45. The corresponding end position is defined by a stop 29 on the first housing part 21. If the second fluid chamber 16 is not supplied with fluid pressure, the brake ring 16 rests on the closure ring 80, wherein the second braking means 71 engage in the first braking means 45.

The second fluid chamber 16 is partially delimited by a sealing surface 26 on the first housing part 21, the said sealing surface being of circular-cylindrical design in relation to the axis of rotation. Both the brake ring 70 and the closure ring 80 rest sealingly against the sealing surface 26, wherein a corresponding sealing ring is provided in each case. When viewed in cross section, the brake ring 70 is of L-shaped design. One leg of the L forms a side wall of the second fluid chamber 16, the pressurization of which brings about a movement of the brake ring 70. The other leg of the L forms a radially inner wall, opposite the sealing surface 26, of the second fluid chamber 16, the pressurization of which does not bring about any movement of the brake ring 70.

The closure ring 80 rests sealingly against the said radially inner wall, wherein a corresponding sealing ring is arranged there. The closure ring 80 likewise forms a side wall of the second fluid chamber. The pressurization of the said chamber gives rise to a force, which is supported by positive engagement on the cam ring 30, with the result that the closure ring 80 does not move during operation. For this purpose, the closure ring 80 is provided with a narrow nose 81, ensuring that it does not touch the cylinder drum 48 in any rotational position. With the cross-sectional profile shown in FIG. 5, the closure ring 80 is of rotationally symmetrical design in relation to the axis of rotation. The second fluid chamber 16 is likewise of rotationally symmetrical design in relation to the axis of rotation.

FIG. 6 shows a perspective view of the brake ring 70 of the radial piston machine shown in FIG. 1. On the end face facing the cylinder drum (No. 48 in FIG. 1), the brake ring 70 is provided with second braking means 71. The second braking means 71 comprise a multiplicity of second extensions 72, which are arranged in a uniformly distributed manner around the axis 11 of rotation at a constant pitch 12. The second extensions 72 are of identical design to one another, wherein the spacing thereof with respect to the axis 11 of rotation is likewise identical. The side faces 74 thereof engage positively between the first extensions (No. 46 in FIG. 3), which form the first braking means. The said side faces 74 can be of flat and sloping design, with the result that the said positive engagement is canceled when a predetermined torque is exceeded. For this purpose, the side faces 74 can also be of rounded design. The second extensions 72 are of identical design to the first extensions (No. 46 in FIG. 3). The pitch 12 of the first and the second braking means 71 is of identical design.

The third extensions 73, which have already been mentioned, are provided on the inner circumferential surface of the brake ring 70, the said extensions engaging in the second recesses (No. 25 in FIG. 4) in order to secure the brake ring 70 positively against twisting around the axis 11 of rotation. It should be noted that the free space between the third extensions 73 does not pass through the brake ring in the direction of the axis 11 of rotation over the entire width, and therefore it does not intersect the second braking means 71. At the opposite end, the said free space is of open design to enable the brake ring 70 to be brought into engagement with the first housing part (No. 21 in FIG. 4).

With the cross-sectional shape shown in FIG. 5, the outer circumferential surface of the brake ring 70 is of rotationally symmetrical design in relation to the axis 11 of rotation. The rear end face of the brake ring 70, which is not visible in FIG. 6, is designed to be flat and perpendicular to the axis 11 of rotation.

Figure 7:
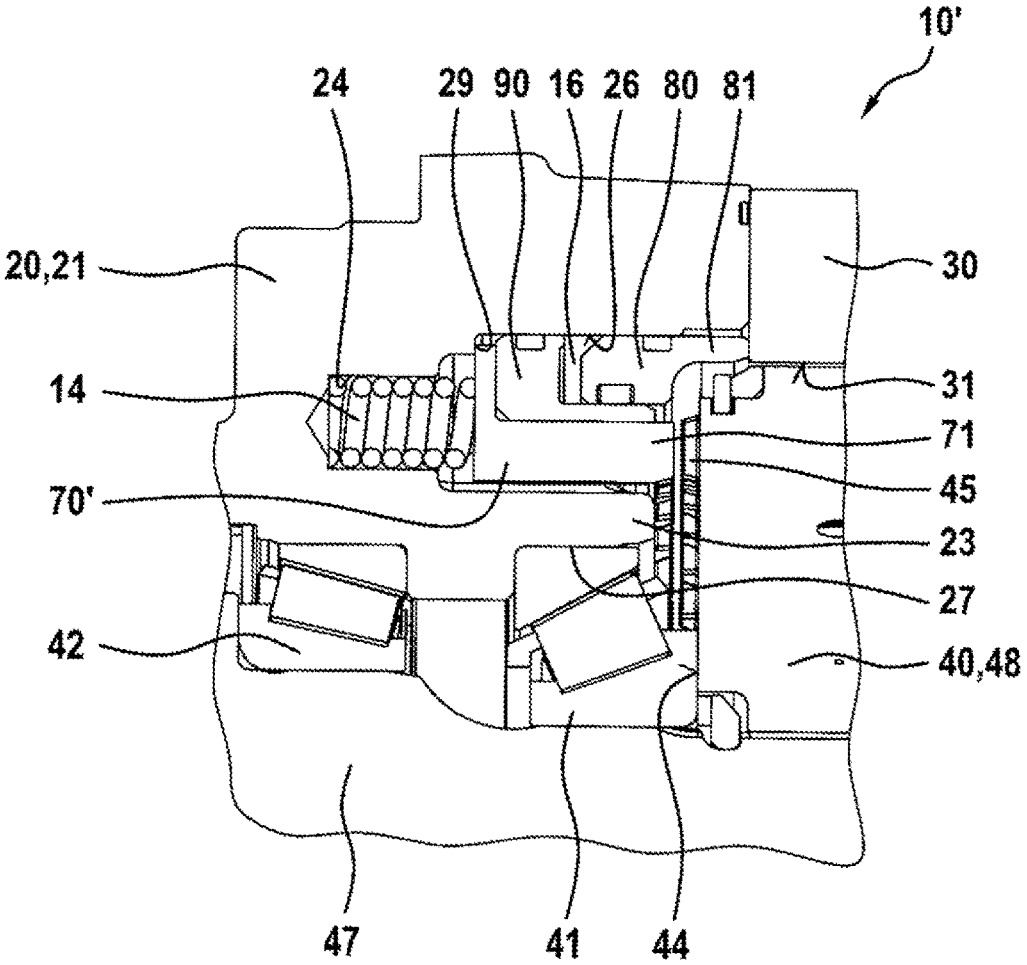
FIG. 7 shows a view corresponding to FIG. 5 of a second embodiment of the disclosure.

FIG. 7 shows a view corresponding to FIG. 5 of a second embodiment of the disclosure. Apart from the differences described below, the second embodiment is of identical design to the first embodiment, and, to this extent therefore, reference can be made to the statements relating to FIGS. 1 to 6. Here, identical or corresponding parts in FIGS. 1 to 8 are provided with the same reference numerals. In particular, the cylinder drum 48 shown in FIG. 3, the first housing part 21 shown in FIG. 4 and the closure ring 80 shown in FIG. 5 are of identical design in both embodiments.

Instead of the integral brake ring in the first embodiment, a brake ring 70' and a separate annular piston 90 are provided in the second embodiment. The annular piston 90 delimits the second fluid chamber 16 in the same way as the brake ring (No. 70 in FIG. 5) in the first embodiment. The annular piston 90 is mounted on the brake ring 70' so as to be rotatable relative to the axis of rotation. Owing to the friction forces in the corresponding seals, the annular piston 90 does not rotate relative to the housing 20 and the closure ring 80 during operation, although twisting relative to the axis of rotation is possible in principle. There is therefore no risk of wear on the said seals. During operation, the brake ring 70' can perform small rotary movements about the axis of rotation relative to the housing 20 since the engagement between the second recesses (No. 25 in FIG. 4) and the third extensions (No. 73 in FIG. 8) preferably exhibits some play. This rotary movement leads only to a relative movement between the brake ring 70' and the annular piston 90. There are no wear-prone seals arranged there.

The brake ring 70' according to the second embodiment is likewise of L-shaped design, wherein the leg of the L which is vertical in FIG. 7 brings about positive coupling between the annular piston 90 and the brake ring 70'. The springs 14 also rest against this leg of the L. The stop 29 preferably enters into contact with the vertical leg 20 of the L. The leg of the L which is horizontal in FIG. 7 forms a bearing surface for the annular piston 90 which is circular-cylindrical in relation to the axis of rotation. With the cross-sectional shape shown in FIG. 7, the annular piston 90 is of rotationally symmetrical design in relation to the axis of rotation.

Figure 8:
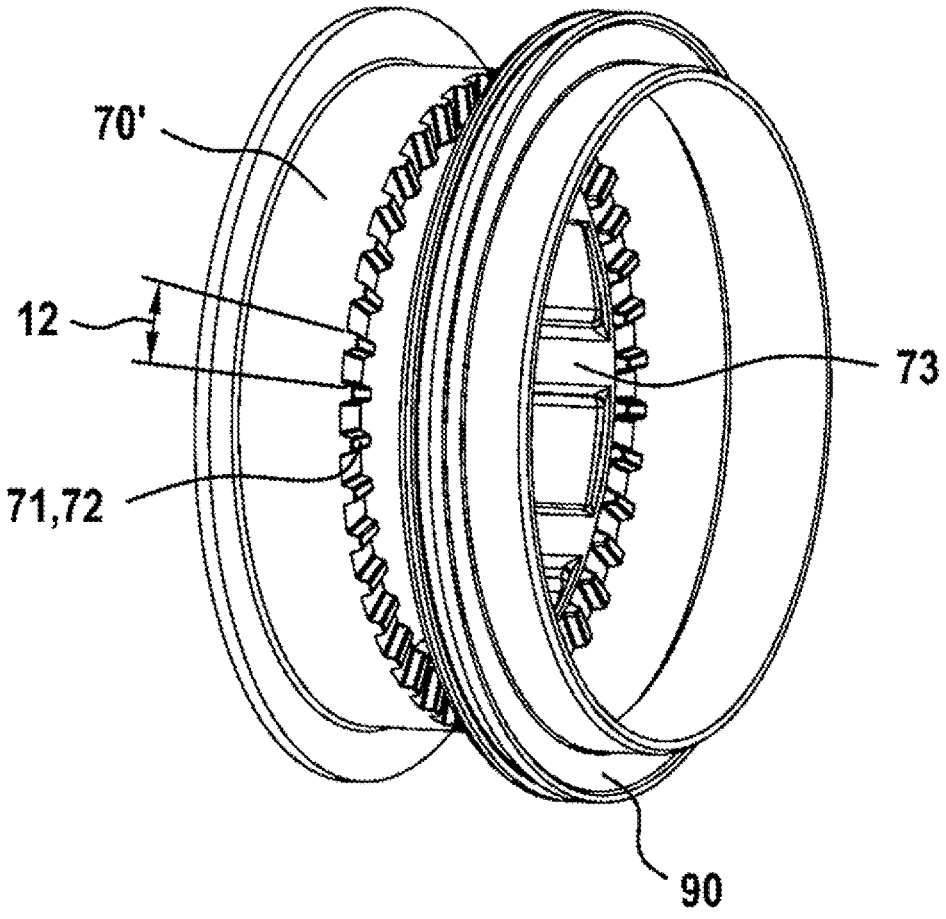
FIG. 8 shows an exploded view of the brake ring and of the annular piston of the axial piston machine shown in FIG. 7.

FIG. 8 shows an exploded view of the brake ring 70' and of the annular piston 90 of the axial piston machine shown in FIG. 7. The inner circumferential surface of the brake ring 70' with the third extensions 73 is of identical design to the inner circumferential surface of the brake ring (No. 70 in FIG. 6) according to the first embodiment. The same applies to the second braking means 71. The end face of the brake ring 70' opposite the second braking means 71 is designed so as to be flat and perpendicular to the axis of rotation.

REFERENCE SIGNS

10 radial piston machine (first embodiment)
10' radial piston machine (second embodiment)
11 axis of rotation
12 pitch
13 fluid distribution device
14 spring
15 first fluid chamber
16 second fluid chamber
17 first fluid connection
18 interior
19 distribution surface
20 housing
21 first housing part
22 second housing part
23 ring-like extension
24 first recess
25 second recess
26 sealing surface
27 bearing seat
28 bore
29 stop
30 cam ring
31 control surface
40 rotor
41 first rotary bearing
42 second rotary bearing
43 cylinder bore
44 end face
45 first braking means
46 first extension
47 drive shaft
48 cylinder drum
49 splined profile
50 drive means
51 seal
52 fluid passage
53 side face of the first extension
60 piston
61 roller
62 retention ring
63 driving piston
64 driven piston
65 piston in the extreme position
70 brake ring (first embodiment)
70' brake ring (second embodiment)
71 second braking means
72 second extension
73 third extension
74 side face of the second extension
80 closure ring
81 nose
90 annular piston

What is claimed is:

1. A radial piston machine, comprising:

a control surface that runs continuously around, and faces, an axis of rotation, wherein a spacing between the axis of rotation and the control surface varies along the circumference of the control surface;

a housing including a ring-shaped extension, the ring-shaped extension extending along the axis of rotation;

a rotor mounted in the housing so as to be rotatable relative to the axis of rotation, the rotor having an end face facing in a direction of the axis of rotation;

a first braking member positioned on the end face of the rotor;

a brake ring that is separate from the housing, that is positioned so as to surround the extension of the housing, that includes a second braking member, and that is configured to (i) be movable along the axis of rotation so as to bring the second braking member into braking engagement with the first braking member, and (ii) positively engage an outer radial side of the ring-shaped extension of the housing to limit a twisting between the housing and the brake ring; and at least one piston positioned in the rotor so as to be radially movable with respect to the axis of rotation, wherein:

a path of movement for the piston that is directed radially outwardly is limited by the control surface; and a radial inner side of the at least one piston and the rotor delimit a first fluid chamber associated with the at least one piston.

2. The radial piston machine of claim 1, further comprising:

a first rotary bearing positioned on the inner radial side of the extension of the housing, wherein the rotor is mounted in the first rotary bearing so as to be rotatable relative to the axis of rotation.

3. The radial piston machine of claim 2, wherein the end face of the rotor supports the first rotary bearing along the axis of rotation.

4. The radial piston machine of claim 1, wherein the end face of the rotor, excluding a region of the first braking member, is flat and aligned perpendicularly to the axis of rotation.

5. The radial piston machine of claim 1, further comprising:

at least one spring that is preloaded and that is positioned between the brake ring and the housing so as to push the brake ring toward the end face of the rotor along the axis of rotation.

6. The radial piston machine of claim 1, wherein:

the housing at least partially delimits a second ring-shaped fluid chamber located around the brake ring; and the brake ring is configured to move along the axis of rotation in response to a pressurization of the second fluid chamber.

7. The radial piston machine of claim 6, further comprising:

a separate closure ring that is positioned in a ring-like fashion around the brake ring such that a radially outer side of the closure ring rests in a fluid tight fashion against the housing, wherein the separate closure ring at least partially delimits the second fluid chamber.

8. The radial piston machine of claim 7, further comprising:

a separate cam ring configured to limit movement of the closure ring along the axis of rotation, wherein the control surface of the housing is positioned on the cam ring.

9. The radial piston machine of claim 6, wherein the brake ring at least partially delimits the second fluid chamber.

10. The radial piston machine of claim 6, further comprising:

a separate annular piston that is held on the brake ring so as to be rotatable relative to the axis of rotation, and that at least partially delimits the second fluid chamber, the brake ring configured to limit movement of the annular piston along the axis of rotation.

11. The radial piston machine of claim 6, wherein the housing further defines a sealing surface that is circular-cylindrical relative to the axis of rotation, a section of the sealing surface at least partially delimiting the second fluid chamber.

12. The radial piston machine of claim 1, wherein:

the first braking member is defined by a plurality of first extensions that face toward the brake ring, and that are positioned in a uniformly distributed fashion around the axis of rotation at a pitch;

the second braking member is defined by a plurality of second extensions that face toward the first extensions, and that are positioned in a uniformly distributed fashion around the axis of rotation at the pitch.

13. The radial piston machine of claim 1, wherein:

the extension of the housing includes at least two second recesses; and the brake ring includes, on a radially inner side of the brake ring, at least two third extensions positioned so as to be distributed around the axis of rotation, each third extension configured to engage with a respective one of the at least two second recesses.

14. The radial piston machine of claim 13, further comprising:

at least one spring that is preloaded and that is positioned in a region of a respective one of the at least two second recesses between the brake ring and the housing so as to push the brake ring toward the end face of the rotor along the axis of rotation.

* * * * *